US006611998B1

(12) United States Patent
Stiglic

(10) Patent No.: US 6,611,998 B1
(45) Date of Patent: Sep. 2, 2003

(54) CLOSURE DEVICE

(75) Inventor: Jeffrey S. Stiglic, Tinley Park, IL (US)

(73) Assignee: the glad products company, Oakland, CA (US)

( * ) Notice: Subject to any disclaimer, the term of this patent is extended or adjusted under 35 U.S.C. 154(b) by 0 days.

(21) Appl. No.: 09/979,526

(22) PCT Filed: Jun. 10, 1999

(86) PCT No.: PCT/US99/13129

§ 371 (c)(1),
(2), (4) Date: Nov. 19, 2001

(87) PCT Pub. No.: WO00/76347

PCT Pub. Date: Dec. 21, 2000

(51) Int. Cl.[7] ..... B65D 33/25
(52) U.S. Cl. ..... 24/427; 24/400
(58) Field of Search ..... 24/400, 418, 427, 24/416, 417, 30.5 R, 30.5 L, DIG. 39, DIG. 40, DIG. 41; 383/63, 64, 211

(56) References Cited

U.S. PATENT DOCUMENTS 3,426,396 A 2/1969 Laguerre
3,790,992 A 2/1974 Herz
4,262,395 A 4/1981 Kosky
5,189,764 A * 3/1993 Herrington et al. ..... 24/384
5,283,932 A * 2/1994 Richardson et al. ..... 24/400
5,448,808 A 9/1995 Gross
5,774,955 A 7/1998 Borchardt et al.

* cited by examiner

*Primary Examiner*—Robert J. Sandy
(74) *Attorney, Agent, or Firm*—Thomas C. Feix

(57) ABSTRACT

The closure device (121) includes interlocking fastening strips (130, 131) and a slider (132) slidably disposed on the fastening strips for facilitating the occlusion and deocclusion of the fastening strips when moved towards first and second ends thereof. Flexible shoulders (230, 232) and legs (234, 236) are disposed on the slider (132) for facilitating the attachment of the slider onto the fastening strips (130, 131) in the vertical Z axis (106). The flexible shoulders (230, 232) and legs (234, 236) further provide resistance against the removal of the slider (132) from the fastening strips (130, 131) in the vertical Z axis (106) thereafter.

123 Claims, 13 Drawing Sheets

CLOSURE DEVICE

FIELD OF THE INVENTION

The present invention relates generally to closure devices and, more particularly, to a slider for closure devices with interlocking fastening strips. The inventive slider may be employed in traditional fastener areas, and is particularly well suited for fastening flexible storage containers, including plastic bags.

BACKGROUND OF THE INVENTION

The use of closure devices for fastening storage containers, including plastic bags, is generally well known. Furthermore, the manufacture of closure devices made of plastic materials is generally known to those skilled in the art, as demonstrated by the numerous patents in this area.

A particularly well-known use for closure devices is in connection with flexible storage containers, such as plastic bags. In some instances, the closure device and the associated container are formed from thermoplastic materials, and the closure device and the side walls of the container are integrally formed by extrusion as a single piece. Alternatively, the closure device and side walls of the container may be formed as separate pieces and then connected by heat sealing or any other suitable connecting process. In either event, such closure devices are particularly useful An providing a closure means for retaining matter within the bag.

Conventional closure devices typically utilize mating male and female fastening strips or closure elements which are used to selectively seal the bag. With such closure devices, however, it is often difficult to determine whether the fastening strips are fully occluded. This problem is particularly acute when the strips are relatively narrow. Accordingly, when such fastening strips are employed, there exists a reasonable likelihood that the closure device is at least partially open.

Such fastening strips devices are also particularly difficult to handle by individuals with limited manual dexterity. Thus, in order to assist these individuals and for ease of use by individuals with normal dexterity, the prior art has also provided sliders for use in opening and closing the fastening strips, as disclosed, for example, in U.S. Pat. Nos. 4,199,845, 5,007,142, 5,007,143, 5,010,627, 5,020,194, 5,070,583, 5,283,932, 5,301,394, 5,426,830, 5,431,760, 5,442,838, and 5,448,808. Some of these sliders include a separator finger which extends at least partially between the fastening strips. When the slider is moved in the appropriate direction, the separator finger divides the fastening strips and opens the bag.

During assembly of closure devices utilizing sliders, the sliders are often mounted onto fastening strips by moving the slider over the fastening strips in the vertical axis. Specifically, if the longitudinal axis of the fastening strips and slider is the X axis, the width is the transverse Y axis and the height is the vertical Z axis, the slider is attached to the fastening strips by moving the slider over the fastening strips in the vertical Z axis. In the past, sliders attached in the vertical Z axis have utilized either a multi-part or folding design. In either case the slider must be properly positioned along the fastening strip while the slider components are either snapped or ultrasonically welded together. These procedures increase the manufacturing costs. Examples of sliders with multiple parts are disclosed in U.S. Pat. Nos. 5,007,142 and 5,283,932 and folding plastic sliders in U.S. Pat. Nos. 5,067,208, 5,070,583, and 5,448,808. The prior art has failed to afford a slider that is attached to the fastening strips in the vertical Z axis through a single step process. It would be desirable to have a slider that may be attached to the fastening strips in the vertical Z axis by merely urging the slider over the fastening strips. Such a device would reduce the manufacturing costs of closure devices utilizing sliders in addition to providing an effective and reliable means of attaching sliders to the fastening strips.

OBJECTS OF THE INVENTION

Accordingly, a general object of the present invention is to provide a slider which overcomes the deficiencies of the prior art.

A more specific object of the present invention is to provide a one piece slider that may be attached to the fastening strips in the vertical Z axis by merely urging the slider over the fastening strips.

A related object of the present invention is to provide a slider that once attached prevents itself from being removed from the fastening strips thereafter.

SUMMARY OF THE INVENTION

Accordingly, a slider for closure devices is provided which accomplishes these and other objects and overcomes the above-identified drawbacks of the prior art. The inventive slider is intended for use with a storage container which includes a pair of complementary sheets or opposing flexible side walls, such as a plastic bag. The closure device includes interlocking fastening strips disposed along respective edge portions of the opposing side walls, and a slider slidably disposed on the interlocking fastening strips for facilitating the occlusion and deocclusion of the fastening strips when moved towards first and second ends thereof. In accordance with the present invention, flexible shoulders and legs are disposed on the slider for facilitating the attachment of the slider onto the fastening strips in the vertical Z axis. The flexible shoulders and legs further provide resistance against the removal of the slider from the fastening strips in the vertical Z axis thereafter.

These and other objects, features, and advantages of the present invention will become more readily apparent upon reading the following detailed description of exemplified embodiments and upon reference to the accompanying drawings herein.

While the present invention will be described and disclosed in connection with certain embodiments and procedures, the intent is not to limit the present invention to these embodiments and.procedures. On the contrary, the intent is to cover all such alternatives, modifications, and equivalents that fall within the spirit and scope of the present invention as defined by the appended claims.

DESCRIPTION OF THE EMBODIMENTS

Figure 1:
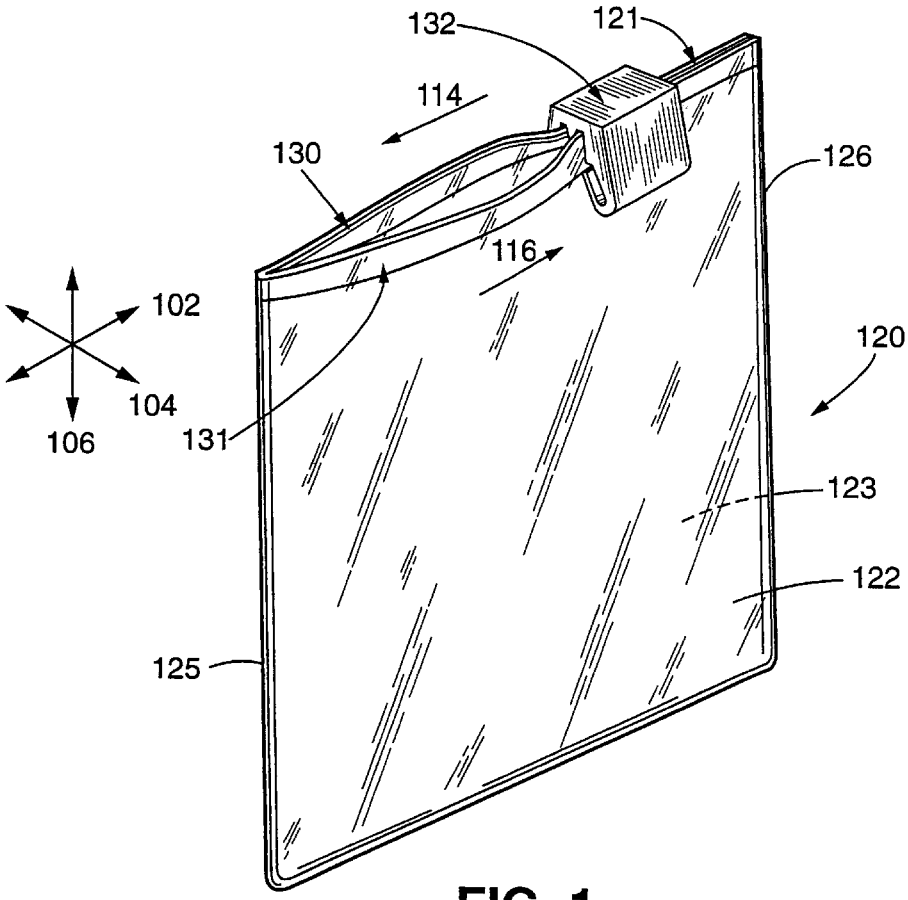
FIG. 1 is a perspective view of a container according to the present invention in the form of a plastic bag.
Figure 2:
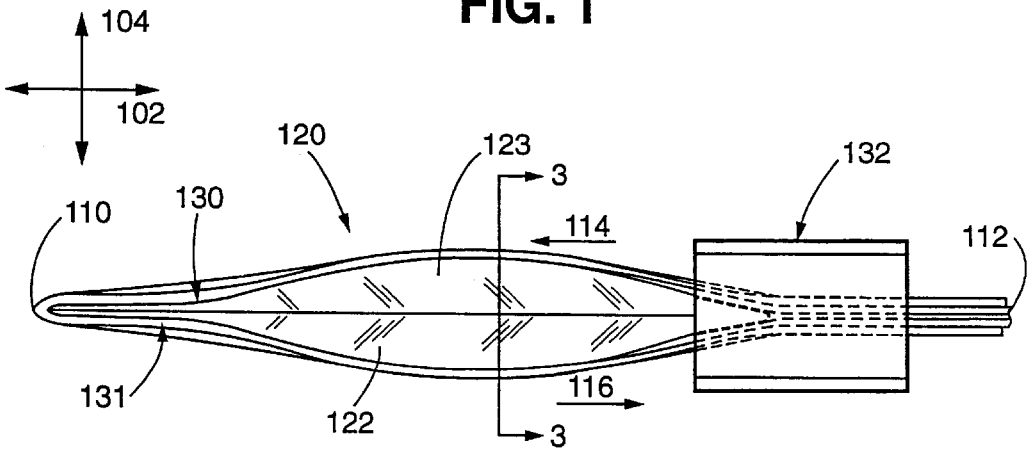
FIG. 2 is a partial top view of the container in FIG. 1.

The present invention provides an interlocking closure device with a slider which establishes a leak proof seal. Turning now to the drawings, FIGS. 1 and 2 illustrate a container in the form of a plastic bag 120 having a sealable closure device 121. The bag 120 includes side walls 122, 123 joined at seams 124, 125 to form a compartment sealable by means of the closure device 121. The closure device comprises first and second fastening strips 130, 131 and a slider 132.

The fastening strips 130, 131 and slider 132 have a longitudinal X axis 102 and a transverse Y axis 104 which is perpendicular to the longitudinal X axis 102. The fastening strips have a vertical Z axis 106 which is perpendicular to the longitudinal X axis 102 and which is perpendicular to the transverse Y axis 104.

In use, the slider 132 of the present invention facilitates the occlusion and deocclusion of the interlocking fastening strips 130, 131 when moved in the appropriate direction along the longitudinal X axis 102 of the strips 130,131. In particular, the slider 132 facilitates the occlusion of the interlocking fastening strips 130, 131 when moved towards a first end 110 thereof, and facilitates the deocclusion of the interlocking fastening strips 130, 131 when moved towards a second end 112 thereof. When the slider 132 is moved in an occlusion direction, as indicated by reference numeral 114 in FIGS. 1 and 2, closure of the fastening strips 130, 131 occurs. Conversely, when the slider 132 is moved in a deocclusion direction, as indicated by reference numeral 116, separation of the fastening strips 130, 131 occurs.

In keeping with a general aspect of the present invention and as will be described in greater detail below, the interlocking fastening strips 130, 131 of the present invention may be of virtually any type or form including, for example: (1) U-channel fastening strips as shown herein at FIG. 3; (2) shear action or Z-axis fastening strips, and as shown herein at FIG. 23; (3) arrowhead-type fastening strips, as disclosed in U.S. Pat. Nos. 5,007,142 and 5,020,194, and as shown herein at FIG. 24; (4) rolling action fastening strips, as disclosed in U.S. Pat. No. 5,007,143, and as shown herein at FIG. 25; and/or (5) Pentabar fastening strips as disclosed in U.S. Pat. 4,516,268. All of the above-identified patents and applications are hereby incorporated by reference in their entireties.

Figure 3:
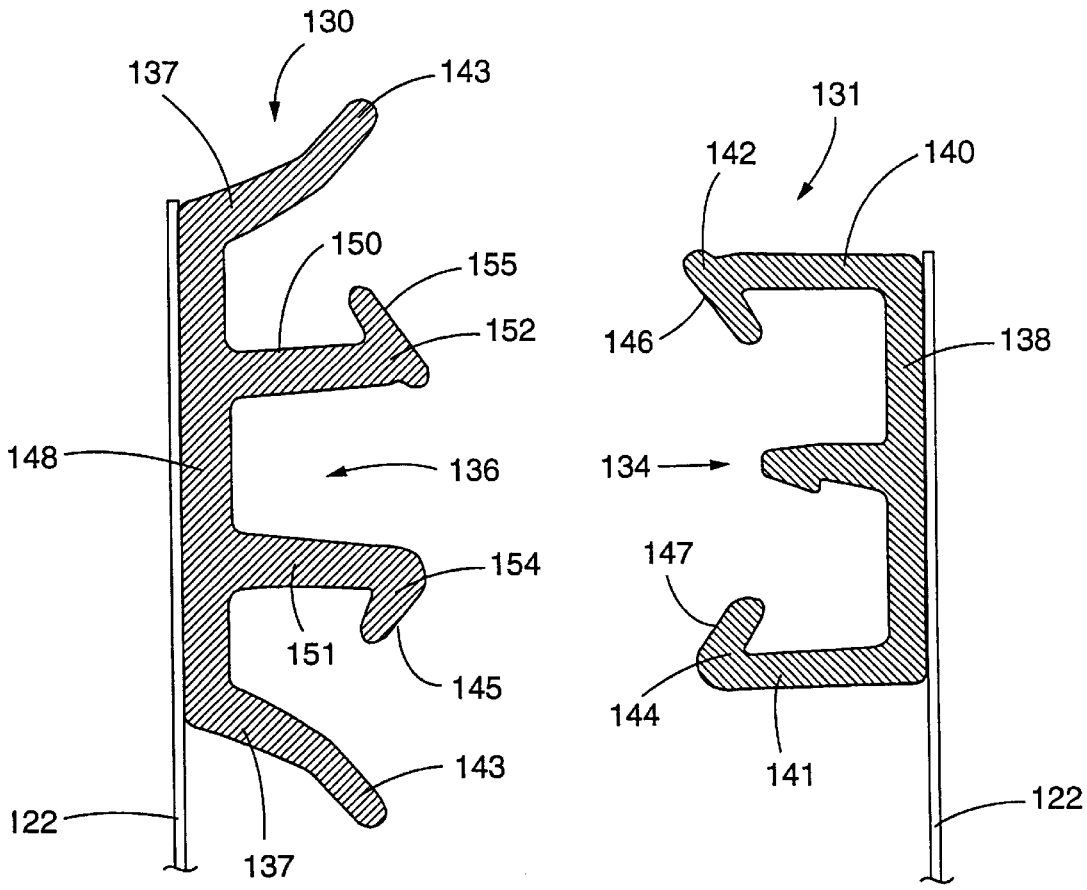
FIG. 3 is a partial cross-sectional view taken along line 3—3 in FIG. 2.
Figure 5:
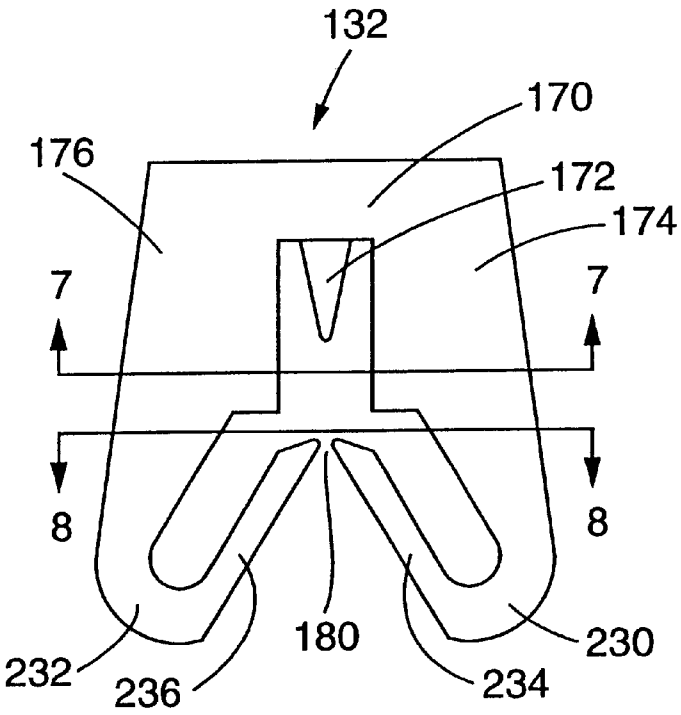
FIG. 5 is a rear view of the slider in FIG. 2.

An illustrative example of the type of closure device that may be used with the present invention is shown in FIG. 3. U-channel fastening strips include a first fastening strip 130 with a first closure element 136 and a second fastening strip 131 with a second closure element 134. The first closure element 136 engages the second closure element 134. The first fastening strip 130 may include a pair of wings 137 spaced-apart on the first fastening strip on each side of the first closure element 136.

The second closure element 134 includes a base portion 138 having a pair of spaced-apart parallely disposed webs 140, 141 extending from the base portion 138. The webs 140, 141 include hook closure portions 142, 144 extending from the webs 140, 141 respectively, and facing towards each other. The hook closure portions 142, 144 include guide surfaces 146, 147 which serve to guide the hook closure portions 142, 144 for occluding with the hook closure portions 152, 154 of the first closure element 136.

The first closure element 136 includes a base portion 148 including a pair of spaced-apart, parallely disposed webs 150, 151 extending from the base portion 148. The webs 150, 151 include hook closure portions 152, 154 extending from the webs 150, 151 respectively and facing away from each other. The hook closure portions 152, 154 include guide surfaces 145, 155, which generally serve to guide the hook closure portions 152, 154 for occlusion with the hook closure portions 142, 144 of the second closure element 134. The guide surfaces 145, 155 may also have a rounded crown surface. In addition, the hook closure portions 144, 154 may be designed so that the hook closure portions 144, 154 adjacent the interior of the container provide a greater resistance to opening the closure device 121. The first fastening strip 130 may include wings 137 as shown in FIG. 3. The wings 137 are flexible and extend from the base 148 of the fastening strip.130. Each wing 137 terminates in an end portion 143 which projects-outwardly from the wing 137.

Referring to FIGS. 4–8, the slider 132 includes a housing 160 and an attaching means 162. The housing 160 may include a top portion 170, a separator finger 172, a first side portion 174, and a second side portion 176. The attaching means 162 includes a first flexible shoulder 230, a second flexible shoulder 232, a first leg 234, a second leg 236, and a slot 180,. The separator finger 172 extends downward from the top portion 170 toward the slot 180. The slider.132 has a first end 184 and a second end 186.

Figure 6:
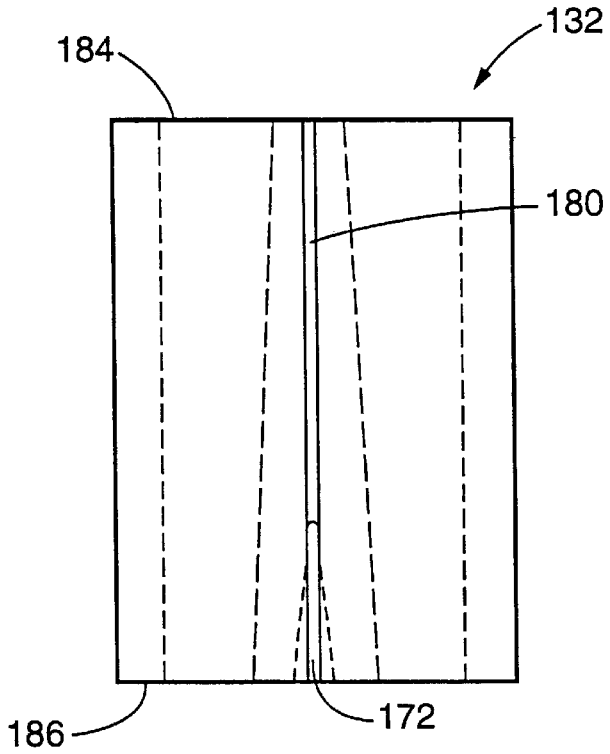
FIG. 6 is a bottom view of the slider in FIG. 2.
Figure 7:
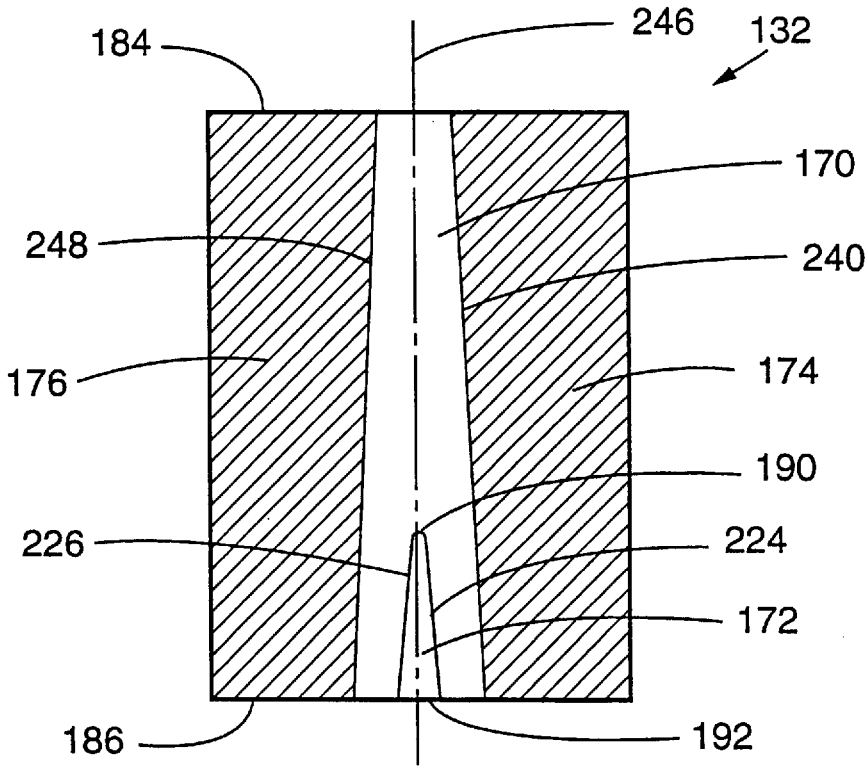
FIG. 7 is a cross-sectional view taken along line 7—7 in FIG. 5.

The separator finger 172 extends from the second end 186 towards the first end 184. The separator finger 172 has a first end 190 and a second end 192. The second end 192 is wider than the first end 190. The separator finger 172 has a first side portion 224 and a second side portion 226. The side portions 224, 226 taper inwardly from the second end 192 to the first end 190 as shown in FIGS. 6 and 7. The separator 172 has a triangular shape as shown in FIG. 7. The separator may have other shapes, such as, trapezoids, ovals, rectangles, circular shapes and any other shape.

Figure 4:
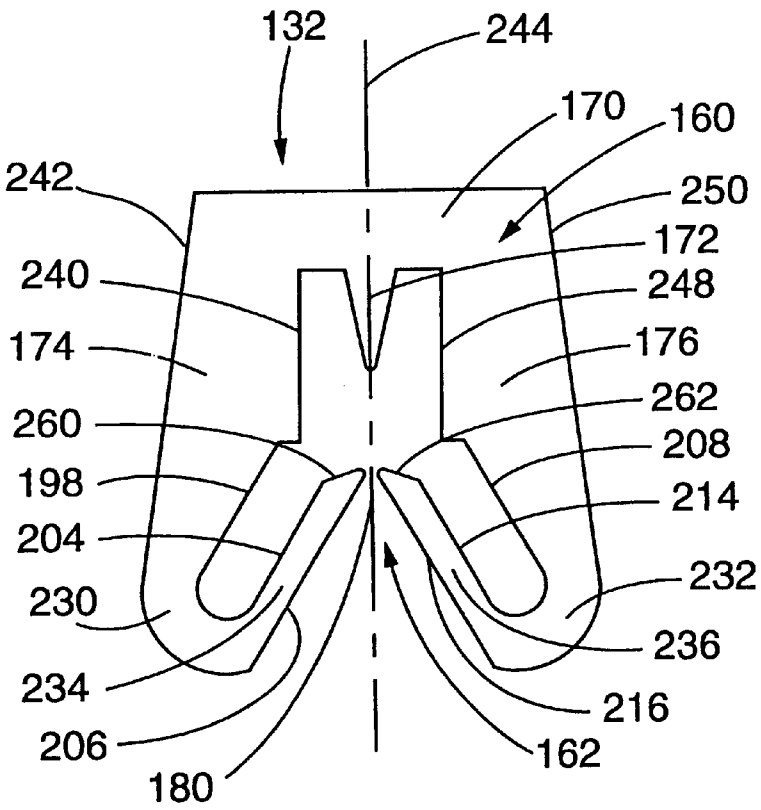
FIG. 4 is a front view of the slider in FIG. 2.

The top portion 170 of the slider merges into a first side portion 174 and a second side portion 176. The first side portion 174 has an upper inner surface 240, a lower inner surface 198, and an outer surface 242. Similarly, the second side portion 176 has an upper inner surface 248, a lower inner surface 208, and an outer surface 250. From the top portion 170 the outside surfaces 242, 250 of the side portions 174, 176 angle outwardly away from the center line 244 as illustrated in FIG. 4. As viewed in FIG. 7, from the second end 186 the inner surfaces 240, 248 of the side portions 174, 176 angle inwardly toward the center line 244 246 of the slider 132.

Figure 8:
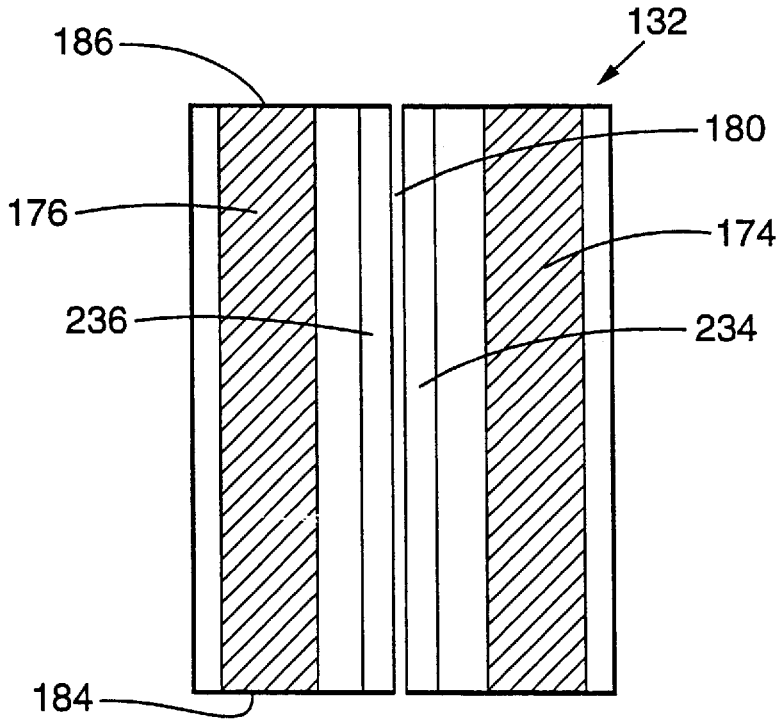
FIG. 8 is a cross-sectional view taken along line 8—8 in FIG. 5.

The first side portion 174 merges into the first leg 234 through the first flexible shoulder 230, thus forming a U shaped configuration. The second side portion 176 merges into the second leg 236 through the second flexible shoulder 232 also creating a U shaped configuration. The first leg 234 of the slider has an inner surface 204, an outer surface 206, and an end surface 260. Accordingly, the second leg 236 has an inner surface 214, an outer surface 216, and an end surface 262. The legs 234, 236 angle inwardly toward the center line 244 and terminate at the end surfaces 260, 262, thereby forming the slot 180. As seen in FIGS. 6 and 8, the slot 180 extends from the first end 184 to the second end 186 of the slider 132 and has substantially the same width from the first end 184 to the second end 186 of the slider 132.

Figure 6A:
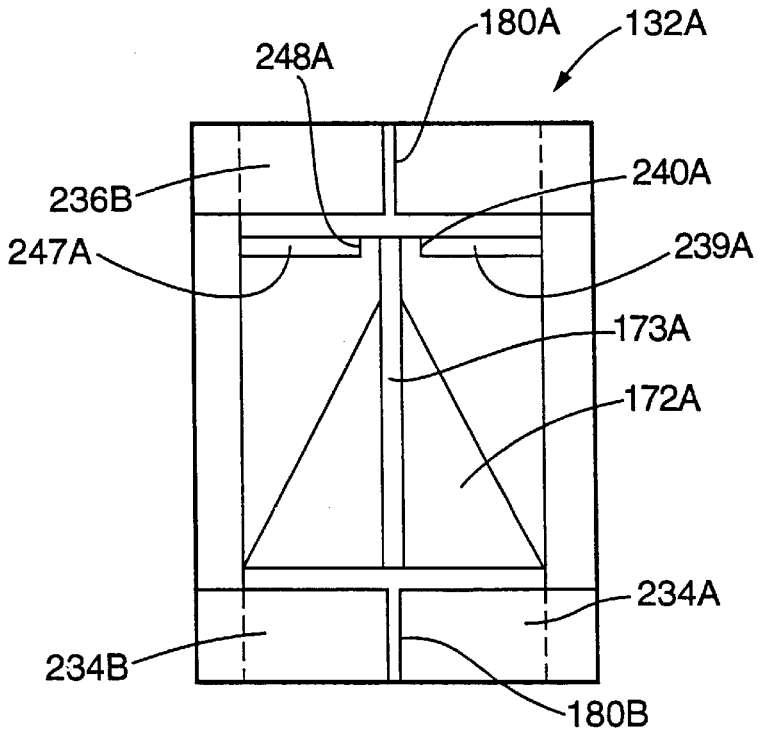
FIG. 6A is a bottom view of another embodiment of the slider.

Another embodiment of the slider is shown in FIG. 6A. In this embodiment, the center portion of the first leg is removed to create leg 234A and leg 234B at the ends of the slider 132A. Similarly, the center portion of the second leg is removed to create leg 236A and 236B. Thus, slots 180A, 180B are used to hold the fastening strips. In addition, the separator 172A is longer and wider than the separator 172 in FIG. 6. Also, the separator 172A is located in approximately the center of the slider 132A and between the legs 234A, 234B and the legs 236A, 236B. The separator 172A also includes a ridge 173A which has the same height along the length of the separator 172A. The slider 132A has occlusion members 239A, 247A with inner surfaces 240A, 248A. The inner surfaces 240A, 248A engage the sides o the fastening strips and cause the fastening strips to occlude.

In a relaxed state, the legs 234, 236 of the slider 132 are substantially parallel to the respective lower inner surfaces 198, 208 of the side portions 174, 176. Consequently, a void volume is formed between each of the lower inner surfaces 198, 208 of the side portions 174, 176 and the respective inner surfaces 204, 214 of the legs 234, 236 thus creating an area through which the legs 234, 236 may move outwardly away from the center line 244 during attachment of the slider 132 onto a closure device 121.

In accordance with a principal aspect of the present invention, a slider 132 is provided with flexible shoulders 230, 232 which provide a means of attaching the slider 132 to the fastening strips in the vertical Z axis 106 while preventing the slider 132 from being removed in the vertical Z axis 106 thereafter. It will be appreciated by those skilled in the art that the slider 132 may be molded from any suitable plastic material.

Figure 11:
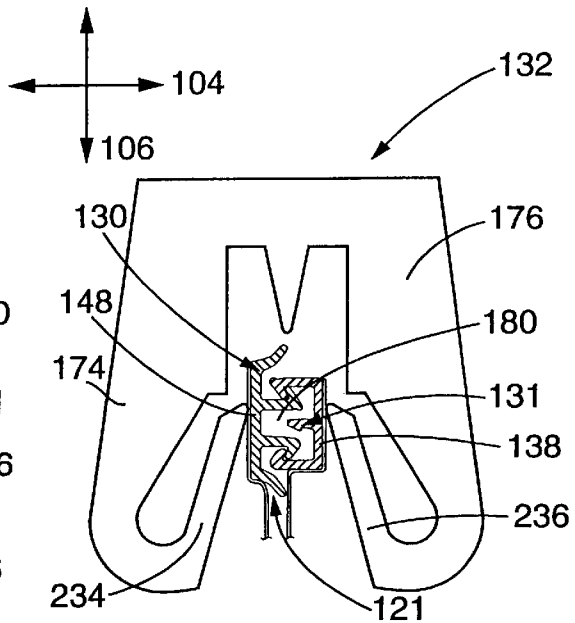
FIG. 11 is a front view of the slider and cross-sectional view of the fastening strips and illustrates their respective positions to one another as the slider is positioned onto the fastening strips.
Figure 10:
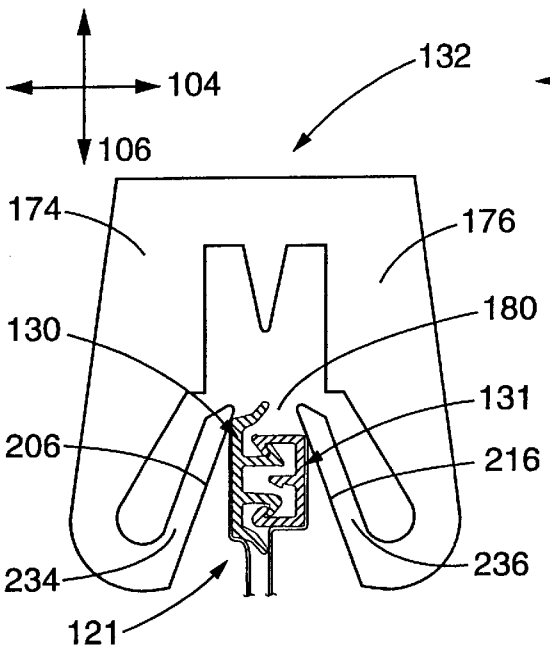
FIG. 10 is a front view of the slider and cross-sectional view of the fastening strips and illustrates their respective positions to one another as the slider is positioned onto the fastening strips.
Figure 9:
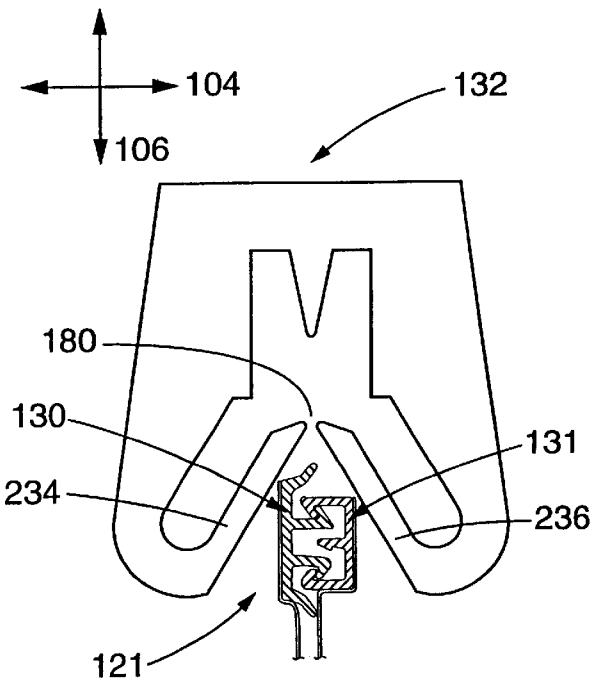
FIG. 9 is a front view of the slider and cross-sectional view of the fastening strips and illustrates their respective positions to one another as the slider is positioned onto the fastening strips.

FIGS. 9–13 sequentially illustrate the attachment of a slider 132 made in accordance with the present invention onto first and second fastening strips 130, 131 in the vertical Z axis 106. FIG. 9 depicts occluded fastening strips 130, 131 and a slider 132 having first and second legs 234, 236 in a relaxed position. The closure device 121 is between the first and second legs 234, 236 immediately below the slot 180. Referring to FIG. 10, the slider 132 is moved in the vertical Z axis 106 toward the fastening strips 130, 131. The fastening strips 130, 131 engage the outer surfaces 206, 216 of the legs 234, 236 and move or deflect the legs 234, 236 outwardly. Consequently, She first and second legs 234, 236 flex outwardly in the transverse Y axis 104 toward their respective side portions 174, 176, and the slot 180 is widened. FIG. 11 illustrates the fastening strips 130, 131 moving through the slot 180. The base portions 148, 138 of the first and second fastening strips 130, 131 are interposed between the legs 234, 236 and further move or deflect the legs 234, 236 outwardly in the transverse Y axis 104 toward their respective side portions 174, 176.

Figure 12:
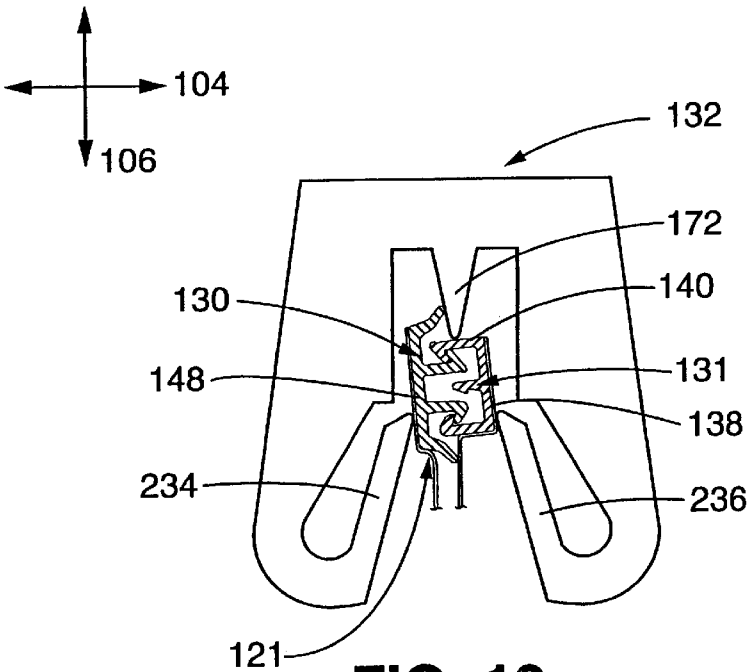
FIG. 12 is a front view of the slider and cross-sectional view of the fastening strips and illustrates their respective positions to one another as the slider is positioned onto the fastening strips.

As the closure device 121 continues through the slot 180 as shown in FIG. 12, the fastening strips 130, 131 are brought into contact with the separator finger 172. More particularly, the web 140 of the second fastening strip 131 is forced against the separator finger 172 while the base portions 148, 138 of the first and second fastening strips 130, 131 remain interposed between the legs 234, 236.

Figure 13:
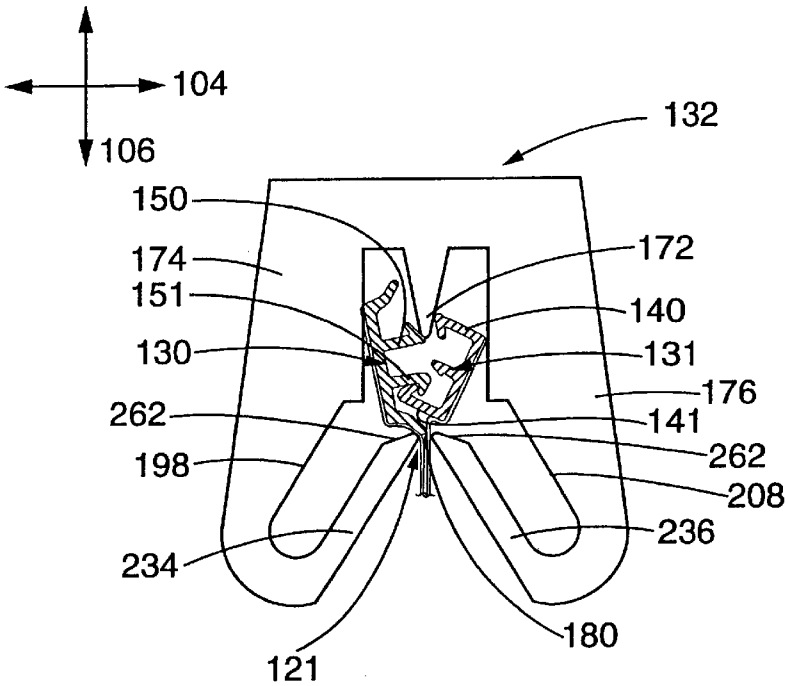
FIG. 13 is a front view of the slider and cross-sectional view of the fastening strips and illustrates their respective positions to one another as the slider is positioned onto the fastening strips.

As seen in FIG. 13, upon further movement of the fastening strips 130, 131 toward the slider 132 in the vertical Z axis 106, the fastening strips 130, 131 project through the legs 234, 236, and the legs 234, 236 retract back to their relaxed position. In the relaxed position, the legs 234, 236 are substantially parallel to the corresponding inner surfaces 198, 208 of the side portions 174, 176. Likewise, the width of the slot 180 returns to its relaxed position width. With respect to the fastening strips 130, 131, the separator finger 172 is forced between, or deoccludes, the outer webs 140, 150 of the fastening strips 130, 131. The inner webs 141, 151 may remain occluded.

FIG. 13 represents the attached position of the slider 132 on fastening strips 130, 131 at the opening end. Once the legs 234, 236 return to their relaxed position, the fastening strips 130, 131 no longer fit through the slot 180. As an aspect of the present invention, the legs 234, 236 effectuate attachment of the slider 132 onto the fastening strips 130, 131 in the vertical Z axis 106 while preventing removal of the slider 132 from the fastening strips 130, 131 in the vertical Z axis 106 after the slider 132 has been attached to the fastening strips 130, 131. In the event removal of the slider 132 in the vertical Z axis 106 is attempted, the legs 234, 236 will provide resistance against the slider's 132 removal. The legs 234, 236 retain the slider 132 on the fastening strips 130, 131 by resisting vertical Z axis 106 movement of the fastening strips 130, 131 through the slot 180. More specifically, the legs 234, 236 are angled upwardly and inwardly so that during insertion of the slider 132 onto the fastening strips 130, 131 the legs move or deflect outwardly in the transverse Y axis 104 to increase the width of the slot 180 and permit the passage of the fastening strips 130, 131. Conversely, in attempting to remove the slider 132 from the fastening strips 130, 131, the fastening strips 130, 131 contact the end portions 260, 262 of the legs 234, 236 and move or deflect the legs 234, 236 inwardly in the transverse Y axis 104. Thus, the width of the slot 180 is reduced until the legs 234, 236 are ultimately forced against one another through the sidewalls 122, 123. The rigidity of the legs 234, 236 and shoulders 230, 232 will resist inward movement of the legs 234, 236 beyond the point where the legs engage each other through the sidewalls 122, 123. As a result, the slider 132 may only be removed from the fastening strips 130, 131 in the vertical Z axis 106 by either tearing through the fastening strips 130, 131 or breaking and/or by deforming the legs 234, 236 of the slider 132.

Figure 14:
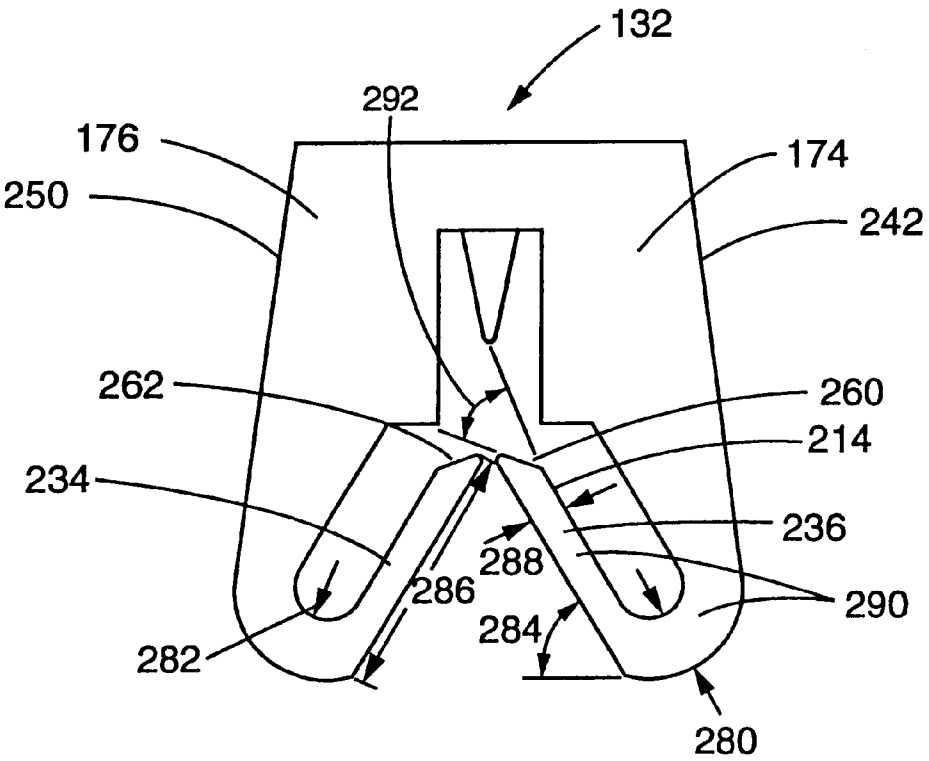
FIG. 14 is a rear view of the slider similar to FIG. 5 and illustrates the properties of the slider design.

It will be appreciated by those skilled in the art that the preset invention may be embodied in a variety of configurations. The resistance the flexible shoulders 230, 232 and legs 234, 236 provide during attachment onto and removal from the fastening strips 130, 131 may be affected by varying the properties of the slider design as shown in FIG. 14. Such properties include: shoulder thickness 280; shoulder radius 282; leg angle 284; leg length 286; leg thickness 288; the material composition 290 of the shoulder and leg; and the angle 292 of the end portions 260, 262. For example, if the shoulder thickness 280 is reduced, then the legs 234, 236 will move or deflect with less force. As another example, if the leg length 286 is reduced, then the legs 234, 236 will move of deflect with more force. In addition, the angle 292 of the end portions 260, 262 may have different values. As shown in FIG. 14, the angle 292 between end portion 260 and inner surface 214 is approximately 45°. In another example, the angle 292 may be 90°. Furthermore, the angle 292 of surfaces 260, 262 may be the same angle or the angle of surface 260 may be at a different angle than the angle of surface 262.

Figure 15:
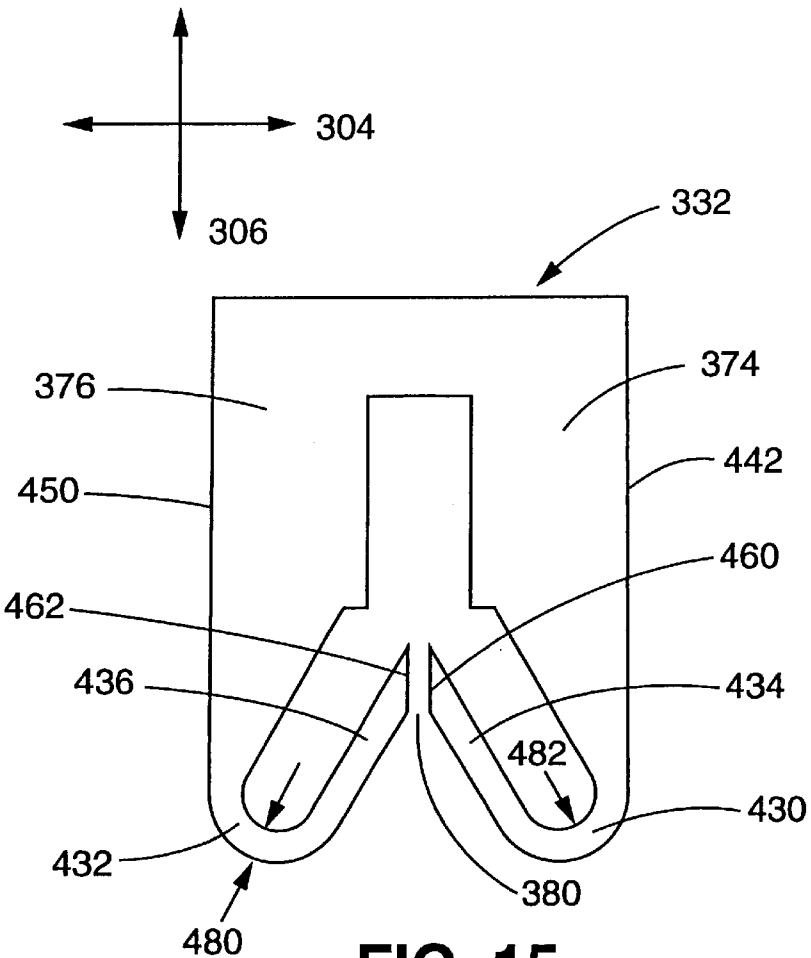
FIG. 15 is a rear view of another embodiment of the slider.

FIG. 15 illustrates a second embodiment of a slider 332 made in accordance with the present invention. As compared with the first embodiment illustrated in FIG. 14, the second embodiment has a first and second side portion 374, 376 with substantially parallel outside surfaces 442, 450. As noted above, the dimensions of the shoulders 430, 432 and legs 434, 436 affect the functionality of the slider 332 during attachment onto and attempted removal from the fastening strips. With respect to the shoulders 430, 432, the shoulder thickness 480 of the second embodiment is less than the shoulder thickness 280 in the first embodiment. In addition, the inner radius 482 of the flexible shoulders 430, 432 is greater than that of the radius 282 of the first embodiment. Consequently, the shoulders of second embodiment will flex more easily than the shoulders of the first embodiment during attachment of the slider 332 onto the fastening strips. Furthermore, the end portions 460, 462 of the legs 434, 436 extend vertically and define the slot 380. Thus, as compared to the first embodiment the end portions 460, 462 provide a larger contact surface area that flexibly resists the passage of the fastening strips through the legs 434, 436 during attachment of the slider 332 onto the fastening strips in the vertical Z axis 306 and during the attempted removal of the slider 332 from the fastening strips in the vertical Z axis 306.

Figure 16:
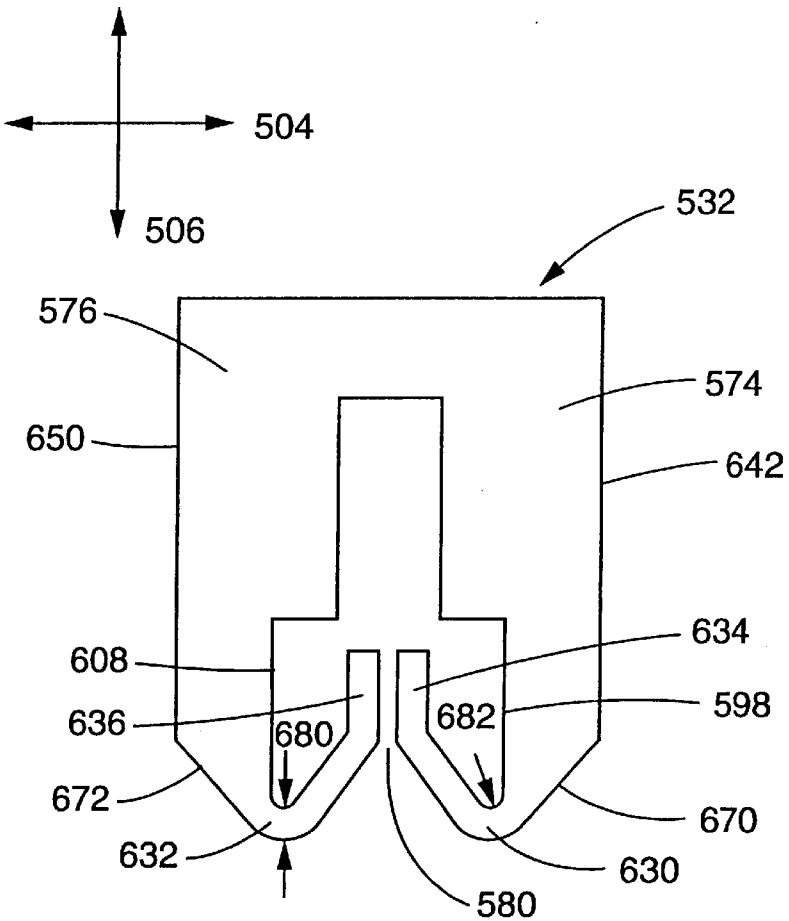
FIG. 16 is a rear view of another embodiment of the slider.

FIG. 16 illustrates a third embodiment of a slider 532 made in accordance with the present invention. As with the second embodiment, the third embodiment also has first and second side portions 574, 576 with substantially parallel outside surfaces 442, 450. However, the lower outer surfaces 670, 672 of the side portions 574, 576 taper inwardly before merging into the flexible shoulders 630, 632. The lower inner surfaces 598, 608 of the side portions 574, 576 are substantially vertical and parallel. The shoulder thickness 680 of the third embodiment is similar to that of the second embodiment. However, the shoulder radius 680 is much smaller than both the first and second embodiments. The legs 634, 636 angle inwardly and, before touching one another, extend vertically thereby defining the slot 580. As compared to the first embodiment the vertical portion of the legs 634, 636 provide a larger contact surface area that flexibly resists the passage of the fastening strips through the legs 634, 636 during attachment of the slider 532 onto the fastening strips in the vertical Z axis 506 and the attempted removal of the slider 332 from the fastening strips in the vertical Z axis 506.

Figure 17:
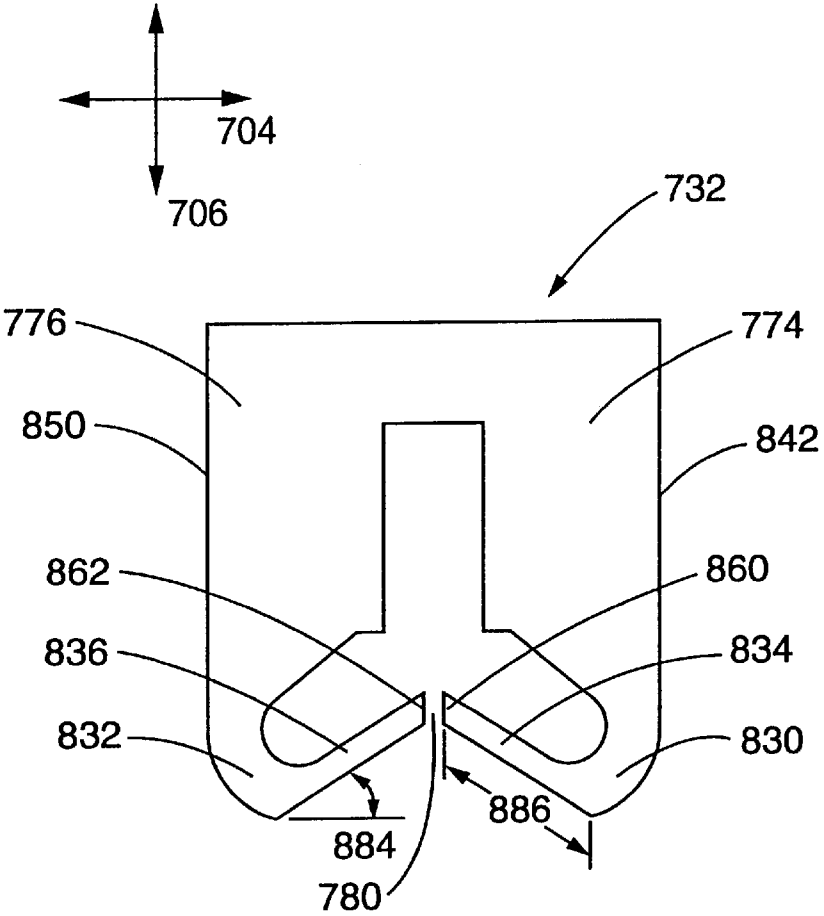
FIG. 17 is a rear view of another embodiment of the slider.

FIG. 17 depicts a fourth embodiment of a slider 732 made in accordance with the present invention. The fourth embodiment is similar to the first embodiment illustrated in FIG. 14 except that the fourth embodiment has first and second side portions 774, 776 with substantially parallel outside surfaces 842, 850 and end portions 860, 862 of the legs 834, 836 extending vertically and defining the slot 780. Further, although the legs 774, 776 project inwardly, the angle of projection 884 is reduced. Reducing the angle of projection 884 of the legs 834, 836 may reduce the length 886 of the legs 834, 836 as well. The reduced length 886 of the legs 834, 836 will result in greater leg rigidity. Furthermore, as compared to the first embodiment, the end portions 860, 862 of the fourth embodiment provide a larger contact surface area that flexibly resists the passage of the fastening strips through the legs 834, 836 during attachment of the slider 732 onto the fastening strips in the vertical Z axis 706 and the attempted removal of the slider 732 from the fastening strips in the vertical Z axis 706.

Figure 18:
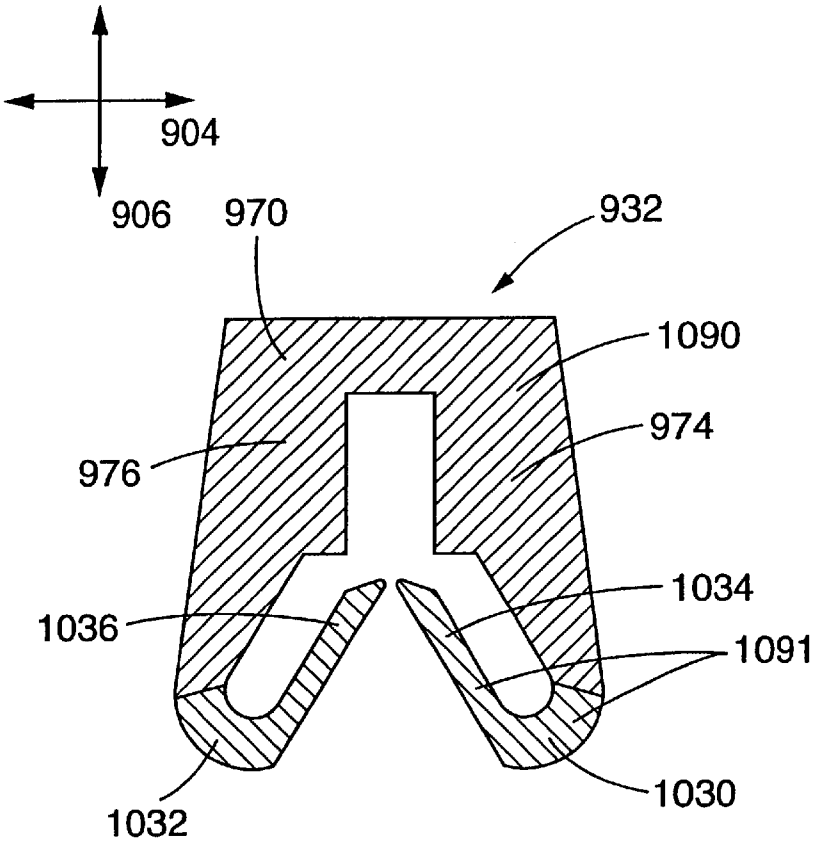
FIG. 18 is a rear view of another embodiment of the slider.

FIG. 18 illustrates a fifth embodiment of a slider 932 made in accordance with the present invention. The fifth embodiment has the same configuration as the first embodiment shown in FIG. 14. The fifth embodiment, however, represents a slider 932 co-extruded from two separate materials, a first material 1090 and a second material 1091. The shoulders 1030, 1032 and legs 1034, 1036 of the slider 932 are molded of the second material 1091. The side 974, 976 and top 970 portions of the slider 932 are molded of the first material 1090. The two materials 1090, 1091 utilized have different flexing characteristics. For example, the shoulders 1030, 1032 and legs 1034, 1036 may be molded of the second material 1091 which is more rigid than the first material 1090 which is used for the side portions 974, 976 and top portions 970. Alternatively, the shoulders 1030, 1032 and legs 1034, 1036 may be molded of a second material 1091 which is less rigid than the first material 1090 which is used for the side portions 974, 976 and top portion 970. The variation of the material composition of the shoulders 1030, 1032 and legs 1034, 1036 may vary the flexible resistance provided by the shoulders 1030, 1032 and legs 1034, 1036 during attachment of the slider 932 onto the fastening strips in the vertical Z axis 906 and the attempted removal of the slider 932 from the fastening strips in the vertical Z axis 906. The co-extrusion of the slider 932 with separate materials 1050, 1052 may reduce manufacturing costs if, for instance, the material used to achieve the desired flexibility of the shoulders 1030, 1032 and legs 1034, 1036 is more costly than that used for the side portions 974, 976 and top portion 970. Consequently, the more expensive material may then be limited to the shoulders 1030, 1032 and legs 1034, 1036 while the less expensive material may be used for the remainder of the slider housing 960. In other embodiments, the side portions could be made of a first material, the shoulders made of a second material, and the legs made of the first material or a third material.

Figure 19:
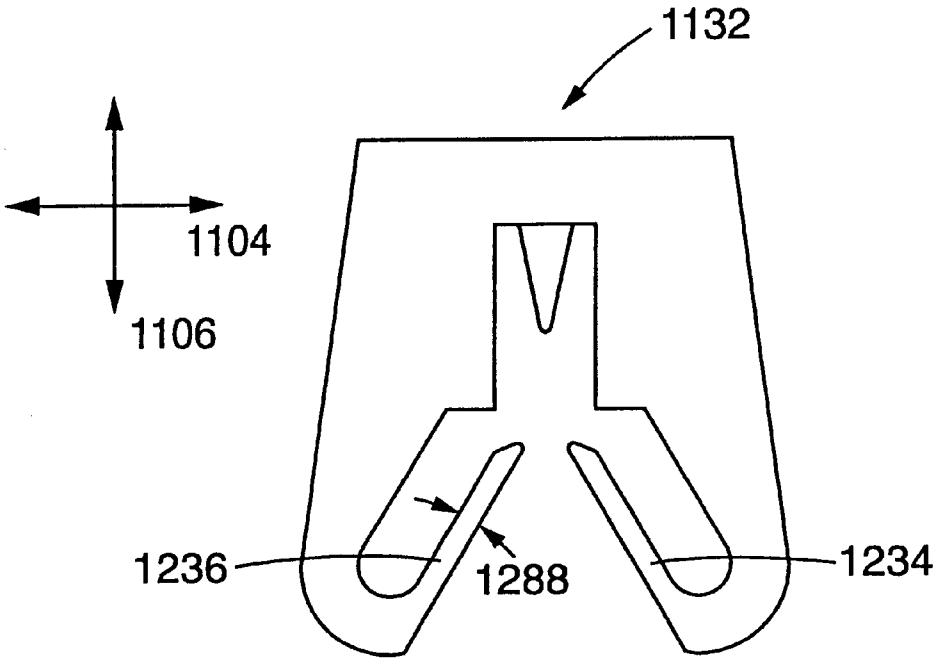
FIG. 19 is a rear view of another embodiment of the slider.

FIG. 19 depicts a sixth embodiment of a slider 1132 made in accordance with the present invention. The sixth embodiment is similar to the first embodiment illustrated in FIG. 14 except the leg width 1288 is reduced. The decreased leg width 1240 will increase the flexibility of the legs and reduce the resistance provided by the legs 1234, 1236 during attachment of the slider 1132 onto and the attempted removal of the slider 1132 from the fastening strips in the vertical Z axis 1106.

Figure 20:
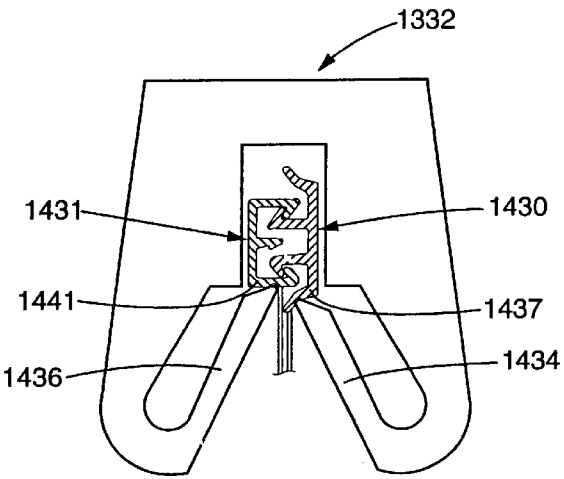
FIG. 20 is a rear view of another embodiment of the slider and a cross-sectional view of the fastening strips.

FIG. 20 illustrates a seventh embodiment of a slider 1332 made in accordance with the present invention. The slider 1332 is shown attached to the fastening strips 1430, 1431. The seventh embodiment is similar to the first embodiment illustrated in FIG. 4 except that the second leg 1436 of the slider 1332 is longer than the first leg 1434. The longer second leg 1436 extends up to the second fastening strip 1431 and more particularly engages the inner web 1441 of the second fastening strip 1431. In addition, the first leg 1434 engages the wing 1437 of the first fastening strip 1430. Thus, the fastening strips 1430, 1431 are held within the slider 1332.

Figure 21:
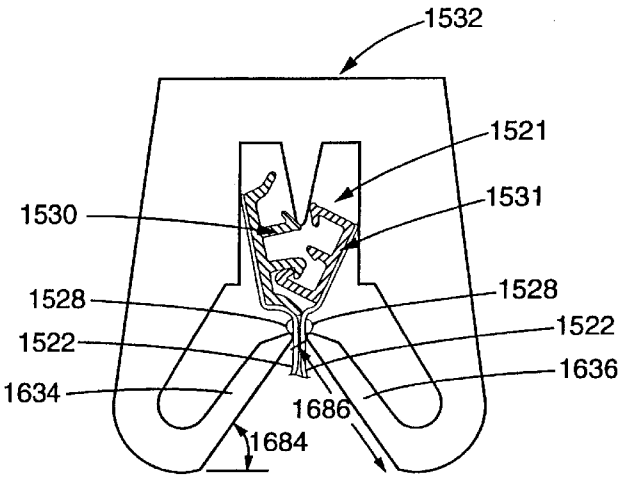
FIG. 21 is a front view of another embodiment of the slider and a cross-sectional view of the fastening strips.
Figure 21A:
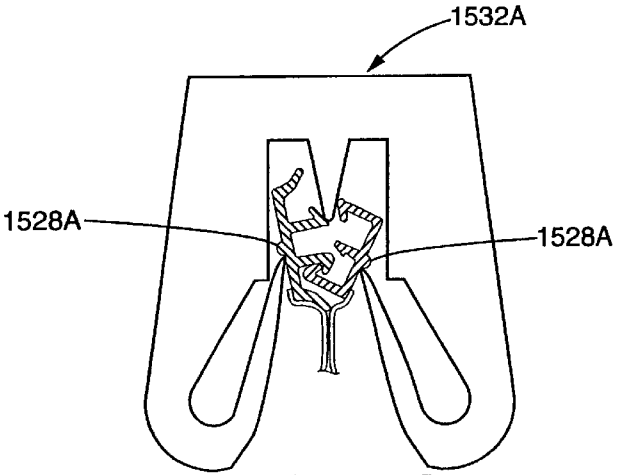
FIG. 21A is a front view of another embodiment of the slider and a cross-sectional view of the fastening strips.

FIG. 21 illustrates an eighth embodiment of a slider 1532 made in accordance with the present invention. The slider 1532 is similar to the first embodiment illustrated in FIG. 14 except that angle of projection 1684 of the legs 1634, 1636 is reduced. Further, reducing the angle of projection 1684 of the legs 1534, 1536 reduces the length 1686 of the legs 1634, 1636 as well. The slider 1532 is designed to work in conjunction with sidewalls 1522 having protrusions 1528 such that the legs 1634, 1636 engage the protrusions 1528 rather than the actual fastening strips 1530, 1531. The protrusions 1528 serve to hold the fastening strips 1530, 1531 within the slider 1532. Further, the reduced length 1686 of the legs 1634, 1636 will result in greater leg rigidity. In another embodiment as shown in FIG. 21A, the protrusions 1528A are located on the fastening strips and the legs engage the protrusions to hold the fastening strips within the slider 1532A.

Figure 22:
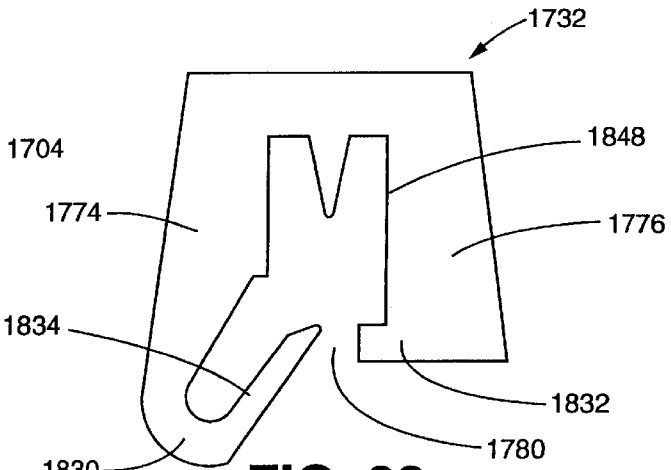
FIG. 22 is a front view of another embodiment of the slider.

FIG. 22 illustrates a ninth embodiment of a slider 1732 made in accordance with the present invention. The ninth embodiment is similar to the first embodiment except that second side portion 1776 terminates at the lower end of the upper inner surface 1848. The second shoulder 1832 is relatively rigid and extends inwardly in a horizontal direction from the second side portion 1776. The first leg 1834 and the second shoulder define a slot 1780. While the second shoulder 1832 aids in maintaining proper orientation of a closure device within the slider 1732, only the first shoulder 1830 and first leg 1834 provide flexibility during attachment of the slider 1732 onto the fastening strips in the vertical Z axis 1706 and resistance during attempted removal of the slider 1732 from the fastening strips in the vertical Z axis 1706. In another embodiment, the second shoulder 1832 is eliminated and the first leg 1834 is lengthened to extend closer to the second side portion 1776 to define a slot 1780. In addition, the second side portion 1776 may be lengthened.

The slider of the present invention may incorporate several configurations. However, the slider should facilitate attachment of the slider onto the fastening strips in the vertical Z axis and prevent the removal of the slider from the fastening strips in the vertical Z axis. Furthermore, the slider facilitates proper orientation of the fastening strips within the slider during operation. Proper orientation of the fastening strips within the slider is usually accomplished by providing legs which support the respective fastening strips. The design of the slider is further dictated by the configuration of fastening strips utilized.

Figure 23:
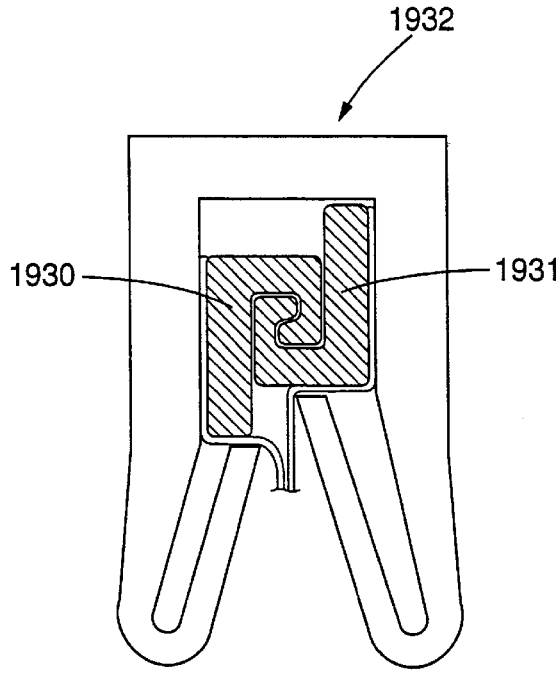
FIG. 23 is a rear view of another embodiment of the slider and a cross-sectional view of another embodiment of the fastening strips.
Figure 24:
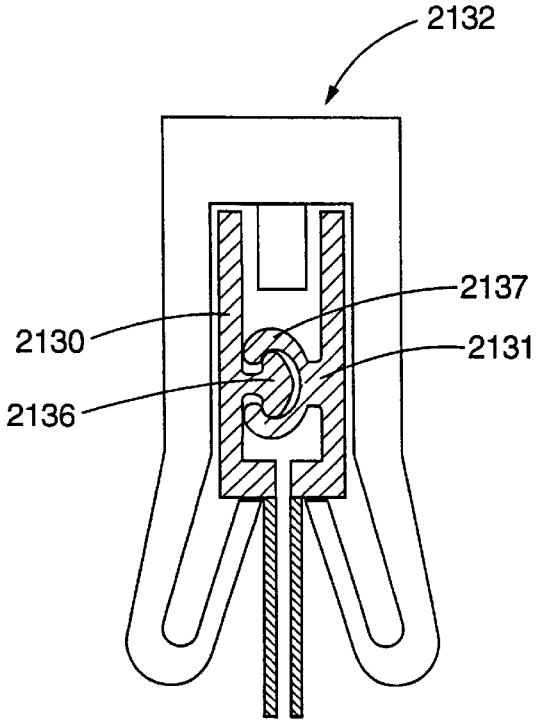
FIG. 24 is a rear view of another embodiment of the slider and a cross-sectional view of another embodiment of the fastening strips.
Figure 25:
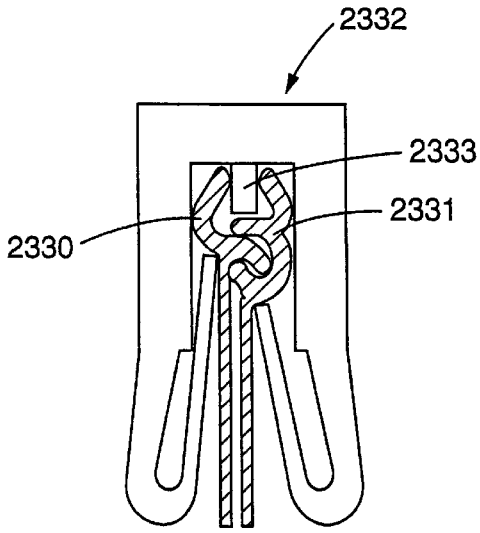
FIG. 25 is a rear view of another embodiment of the slider and a cross-sectional view of another embodiment of the fastening strips.

FIGS. 23–25 illustrate interlocking fastening strips of various configurations and the corresponding slider design. As shown in FIG. 23, the interlocking fastening strips may comprise shear action or Z-axis closure strips. Shear action closure strips include a first fastening strip 1930 and a complementary second fastening strip 1931 which engage upon moving the slider 1932 in the occlusion direction.

In addition, the interlocking fastening strips may alternatively comprise arrowhead-type closure strips, as shown in FIG. 24. As described more fully in U.S. Pat. Nos. 5,007,142 and 5,020,194, arrowhead-type closure strips typically include a first fastening strip 2130 with an arrowhead-shaped engagement portion 2136, and an associated second fastening strip 2131 with a cup-shaped engagement portion 2137. In use, the first fastening strip 2130 and the second fastening strip 2131 are selectively occluded and deoccluded by moving the slider 2132 in the appropriate direction.

The interlocking fastening strips may optionally comprise rolling action closure strips, as shown, for example, in FIG. 25. As described in greater detail in U.S. Pat. No. 5,007,143, rolling action closure strips include first and second elements 2330 and 2331. The first and second elements 2330, 2331 may be deoccluded by using a separator 2333. In use, the elements 2330 and 2331 are selectively occluded and deoccluded by moving the slider 2332 in the appropriate direction.

Although several interlocking fastening strip embodiments have been specifically described and illustrated herein, it will be readily appreciated by those skilled in the art that other kinds, types, or forms of fastening strips may alternatively be used without departing from the scope or spirit of the present invention.

The interlocking fastening strips of the present invention may be manufactured by extrusion through a die, although the die should be made somewhat larger than the desired final dimensions of the fastening strips, inasmuch as shrinkage of the extruded fastening strips is likely upon cooling. In addition, the fastening strips should be manufactured to have approximately uniform cross-sections. This not only simplifies the manufacturing of a closure device, but also contributes to the physical flexibility of the closure device.

Generally, the interlocking fastening strips of the present invention may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to prepare the interlocking fastening strips of the present invention. In most instances, the fastening strips are preferably made from low density polyethylene. The selection of the appropriate thermoplastic material, however, is related to the particular design of the fastening strips, the Young's Modulus of the thermoplastic material, and the desired elasticity and flexibility of the strips.

When the fastening strips of the present invention are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. In most instances, the bag is preferably made from a mixture of high pressure, low density polyethylene and linear, low density polyethylene.

The fastening strips of the present invention may be manufactured by extrusion or other known methods. For example, the closure device may be manufactured as individual fastening strips for later attachment to the bag or may be manufactured integrally with the bag. In addition, the fastening strips may be manufactured with or without flange portions on one or both of the fastening strips depending upon the intended use of the closure device or expected additional manufacturing operations.

Generally, the closure device of the present invention can-be manufactured in a variety of forms to suit the intended use. In practicing the present invention, the closure device may be integrally formed on the opposing side walls of the container or bag, or connected to the container by the use of any of many known methods. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

The slider may be multiple parts and snapped together. In addition, the slider may be made from multiple parts and fused or welded together. The slider may also be a one piece construction. The slider can be colored, opaque or clear. The slider may be injection molded or made by any other method. The slider may be molded from any suitable plastic material, such as, nylon, polypropylene, polystyrene, acetal, toughened acetal, polyketone, polybutylene terrephthalate, high density polyethylene, polycarbonate or ABS (acrylonitrile-butadiene-styrene).

In summary, the present invention provides a closure device that overcomes many of the drawbacks inherent in the prior art. More specifically, the present invention affords a closure device with interlocking fastening strips, a slider which facilitates the occlusion and deocclusion of the fastening strips, and a flexibly resistant attaching means which facilitates attachment of the slider onto the fastening strips in the vertical Z axis and prevents the removal of the slider from the fastening strips in the vertical Z axis thereafter.

From the foregoing it will be understood that modifications and variations may be effectuated to the disclosed structures, particularly in light of the foregoing teachings, without departing from the scope or spirit of the present invention. As such, no limitation with respect to the specific embodiments described and illustrated herein is intended or should be inferred. Indeed, the following claims are intended to cover all modifications and variations that fall within the scope and spirit of the present invention. In addition, all references and copending applications cited herein are hereby incorporated by reference in their entireties.

What is claimed is:

1. A closure device comprising:

a first fastening strip;

a second fastening strip; and a slider adapted to be slidably disposed on said fastening strips and facilitating the occlusion of said fastening strips when moved towards a first end thereof and facilitating the deocclusion of said fastening strips when moved towards a second end thereof, said fastening strips and said slider having a longitudinal X axis and a transverse Y axis, said transverse Y axis being perpendicular to said longitudinal X axis, said fastening strips and said slider having a vertical Z axis, said vertical Z axis being perpendicular to said longitudinal X axis, said vertical Z axis being perpendicular to said transverse Y axis, said slider comprising a housing having a top portion, a first side portion, and a second side portion, said first side portion having a first end and a second end, said second side portion having a first end and a second end, said top portion being operably connected to said first end of said first side portion and said first end of said second side portion, said slider having a first flexible shoulder facilitating the attachment of said slider onto said fastening strips in said vertical Z axis and preventing removal of said slider from said fastening strips in the vertical Z axis thereafter, said first flexible shoulder being operably connected to said second end of said first side portion wherein said first flexible shoulder is operably connected to a first slider leg.

2. The invention as in claim 1, wherein said second end of said second side portion is operably connected to a rigid shoulder.

3. The invention as in claim 1, wherein said fastening strips comprise rolling action fastening strips.

4. The invention as in claim 1, wherein said slider leg projects upwardly and inwardly from said flexible shoulder.

5. The invention as in claim 4, wherein said slider leg and said rigid shoulder defme a slot through which said fastening strips pass during attachment of said slider onto said fastening strips in the vertical Z axis.

6. The invention as in claim 1, wherein said flexible shoulder comprises an inner surface and an outer surface.

7. The invention as in claim 6, wherein said inner surface corn a first radius and said outer surface comprises a second radius.

8. The invention as in claim 1, wherein said slider leg comprises an inner surface, an outer surface, and an end surface.

9. The invention as in claim 8, wherein said inner surface and said outer surface are substantially parallel.

10. The invention as in claim 2, wherein said rigid shoulder projects inwardly from said second side portion.

11. The invention as in claim 9, wherein said rigid shoulder is substantially perpendicular to said second side portion.

12. The invention as in claim 1, wherein said second end of said second side portion is operably connected to a second flexible shoulder.

13. The invention as in claim 12, wherein said second flexible shoulders is operably connected to a second slider leg.

14. The invention as in claim 13, wherein said slider legs project upwardly and inwardly from said flexible shoulders.

15. The invention as in claim 14, wherein said legs define a slot through which said fastening strips pass during attachment of said slider onto said fastening strips in the vertical Z axis.

16. The invention as in claim 12, wherein each said flexible shoulder comprises an inner surface and an outer surface.

17. The invention as in claim 16, wherein said inner surface comprises a first radius and said outer surface comprises a second radius.

18. The invention as in claim 13, wherein said each slider leg comprises an inner surface, an outer surface, and an end surface.

19. The invention as in claim 18, wherein said inner surface and said outer surface are substantially parallel.

20. The invention as in claim 18, wherein said inner surface and said outer surface taper toward said end portion.

21. The invention as in claim 18, wherein said end surfaces are substantially parallel and define said slot.

22. The invention as in claim 18, wherein said end surfaces are in substantially the same plane.

23. The invention as in claim 13, wherein each said slider leg comprises a first inner surface, a second inner surface, a first outer surface, a second outer surface, and an end surface, said first inner surface angles upwardly and inwardly from said flexible shoulder, said second inner surface is substantially vertical, said first outer surface angles upwardly and inwardly and is substantially parallel to said first inner surface, said second outer surface is substantially vertical and substantially parallel to said second inner surface, said second outer surfaces of slider legs define a slot.

24. The invention as in claim 1, wherein said slider leg operably engages said first fastening strip.

25. The invention as in claim 1, wherein said housing is constructed of a first material and said flexible shoulder is constructed of a second material.

26. The invention as in claim 25, wherein said first material is more rigid than said second material.

27. The invention as in claim 25, wherein said second material is more rigid than said first material.

28. The invention as in claim 1, wherein said fastening strips comprise shear action fastening strips.

29. The invention as in claim 1, wherein said fastening strips comprise U-channel type fastening strips.

30. The invention as in claim 1, wherein said fastening strips comprise arrowhead type fastening strips.

31. A slider adapted to be slidably disposed on fastening strips and facilitating the occlusion of said fastening strips when moved towards a first end thereof and facilitating the deocclusion of said fastening strips when moved towards a second end thereof, said slider comprising:

a longitudinal X axis and a transverse Y axis, said transverse Y axis being perpendicular to said longitudinal X axis, said fastening strips and said slider having a vertical Z axis, said vertical Z axis being perpendicular to said longitudinal X axis, said vertical Z axis being perpendicular to said transverse Y axis, said slider comprising a housing having a top portion, a first side portion, and a second side portion, said first side portion having a first end and a second end, said second side portion having a first end and a second end, said top portion being operably connected to said first end of said first side portion and said first end of said second side portion, said slider having a first flexible shoulder facilitating the attachment of said slider onto said fastening strips in said vertical Z axis and preventing removal of said slider from said fastening strips in the vertical Z axis thereafter, said first flexible shoulder being operably connected to said second end of said first side portion, and wherein said first flexible shoulder is operably connected to a first slider leg.

32. The invention as in claim 31, wherein said slider leg operably engages said first fastening strip.

33. The invention as in claim 31, wherein said second end of said second side portion is operably connected to a rigid shoulder.

34. The invention as in claim 31, wherein said housing is constructed of a first material and said flexible shoulder is constructed of a second material.

35. The invention as in claim 34, wherein said first material is more rigid than said second material.

36. The invention as in claim 34, wherein said second material is more rigid than said first material.

37. The invention as in claim 31, wherein said flexible shoulder comprises an inner surface and an outer surface.

38. The invention as in claim 37, wherein said inner surface comprises a first radius and said outer surface comprises a second radius.

39. The invention as in claim 31, wherein said slider leg comprises an inner surface, an outer surface, and an end surface.

40. The invention as in claim 39, wherein said inner surface and said outer surface are substantially parallel.

41. The invention as in claim 33, wherein said rigid shoulder projects inwardly from said second side portion.

42. The invention as in claim 40, wherein said rigid shoulder is substantially perpendicular to said second side portion.

43. The invention as in claim 31, wherein said second end of said second side portion is operably connected to a second flexible shoulder.

44. The invention as in claim 43, wherein said second flexible shoulders is operably connected to a second slider leg.

45. The invention as in claim 44, wherein said slider legs project upwardly and inwardly from said flexible shoulders.

46. The invention as in claim 45, wherein said legs define a slot though which said fastening strips pass during attachment of said slider onto said fastening strips in the vertical Z axis.

47. The invention as in claim 43, wherein each said flexible shoulder comprises an inner surface and an outer surface.

48. The invention as in claim 47, wherein said inner surface comprises a first radius and said outer surface comprises a second radius.

49. The invention as in claim 44, wherein said each slider leg comprises an inner surface, an outer surface, and an end surface.

50. The invention as in claim 49, wherein said inner surface and said outer surface are substantially parallel.

51. The invention as in claim 49, wherein said inner surface and said outer surface taper toward said end portion.

52. The invention as in claim 49, wherein said end surfaces are substantially parallel and define said slot.

53. The invention as in claim 49, wherein said end surfaces are in substantially the same plane.

54. The invention as in claim 44, wherein each said slider leg comprises a first inner surface, a second inner surface, a first outer surface, a second outer surface and an end surface, said first inner surface angles upwardly and inwardly from said flexible shoulder, said second inner surface is substantially vertical, said first outer surface angles upwardly and inwardly and is substantially parallel to said first inner surface, said second outer surface is substantially vertical and substantially parallel to said second inner surface, said second outer surfaces of slider legs define a slot.

55. The invention as in claim 31, wherein said slider leg projects upwardly and inwardly from said flexible shoulder.

56. The invention as in claim 55, wherein said slider leg and said rigid shoulder define a lot through which said fastening strips pass during attachment of said slider onto said fastening strips in the vertical Z axis.

57. A container comprising:

first and second sidewalls, said first and second sidewalls including mating first and second fastening strips respectively, said first and second fastening ships comprising a closure device arranged to be interlocked over a predetermined length, a slider adapted to be slidably disposed on said fastening strips and facilitating the occlusion of said fastening strips when moved towards a first end thereof and facilitating the deocclusion of said fastening strips when moved towards a second end thereof, said fastening strips and said slider having a longitudinal X axis and a transverse Y axis, said transverse Y axis being perpendicular to said longitudinal X axis, said fastening strips and said slider having a vertical Z axis, said vertical Z axis being perpendicular to said longitudinal X axis, said vertical Z axis being perpendicular to said transverse Y axis, said slider comprising a housing having a top portion, a first side portion, and a second side portion, said first side portion having a first end and a second end, said second side portion having a first end and a second end, said top portion being operably connected to said first end of said first side portion and said first end of said second side portion, said slider having a first flexible shoulder facilitating the attachment of said slider onto said fastening strips in said vertical Z axis and preventing removal of said slider from said fastening strips in the vertical Z axis thereafter, said first flexible shoulder being operably connected to said second end of said first side portion and wherein said first flexible shoulder is operably connected to a first slider leg.

58. The invention as in claim 57, wherein said fastening strips comprise U-channel type fastening strips.

59. The invention as in claim 57, wherein said fastening strips comprise rolling action fastening strips.

60. The invention as in claim 57, wherein said slider leg operably engages said first fastening strip.

61. The invention as in claim 57, wherein said first sidewall is between said slider leg and said first fastening strip.

62. The invention as in claim 57, wherein said first sidewall has a protrusion and said slider leg engages said protrusion.

63. The invention as in claim 57, wherein said second end of said second side portion is operably connected to a rigid shoulder.

64. The invention as in claim 57, wherein said fastening strips comprise arrowhead type fastening strips.

65. The invention as in claim 57, wherein said slider leg projects upwardly and inwardly from said flexible shoulder.

66. The invention as in claim 65, wherein said slider leg and said rigid shoulder define a slot through which said fastening strips pass during attachment of said slider onto said fastening strips in the vertical Z axis.

67. The invention as in claim 57, wherein said flexible shoulder comprises an inner surface and an outer surface.

68. The invention as in claim 67, wherein said inner surface comprises a first radius and said outer surface comprises a second radius.

69. The invention as in claim 57, wherein said slider leg comprises an inner surface, an outer surface, and an end surface.

70. The invention as in claim 69, wherein said inner surface and said outer surface are substantially parallel.

71. The invention as in claim 63, wherein said rigid shoulder projects inwardly from said second side portion.

72. The invention as in claim 70, wherein said rigid shoulder is substantially perpendicular to said second side portion.

73. The invention as in claim 57, wherein said second end of said second side portion is operably connected to a second flexible shoulder.

74. The invention as in claim 73, wherein said second flexible shoulders is operably connected to a second slider leg.

75. The invention as in claim 74, wherein said slider legs project upwardly and inwardly from said flexible shoulders.

76. The invention as in claim 75, wherein said legs define a slot through which said fastening strips pass during attachment of said slider onto said fastening strips in the vertical Z axis.

77. The invention as in claim 73, wherein each said flexible shoulder comprises an inner surface and an outer surface.

78. The invention as in claim 77, wherein said inner surface comprises a first radius and said outer surface comprises a second radius.

79. The invention as in claim 74, wherein said each slider leg comprises an inner surface, an outer surface, and an end surface.

80. The invention as in claim 79, wherein said inner surface and said outer surface arm substantially parallel.

81. The invention as in claim 79, wherein said inner surface and said outer surface taper toward said end portion.

82. The invention as in claim 79, wherein said end surfaces are substantially parallel and define said slot.

83. The invention as in claim 79, wherein said end surfaces are in substantially the same plane.

84. The invention as in claim 74, wherein each said slider leg comprises a first inner surface, a second inner surface, a first outer surface, a second outer surface, and an end surface, said first inner surface angles upwardly and inwardly from said flexible shoulder, said second inner surface is substantially vertical, said first outer surface angles upwardly and inwardly and is substantially parallel to said first inner surface, said second outer surface is substantially vertical and substantially parallel to said second inner surface, said second outer surfaces of slider legs define a slot.

85. The invention as in claim 57, wherein said slider leg operably engages said first fastening strip.

86. The invention as in claim 57, wherein said housing is constructed of a first material and said flexible shoulder is constructed of a second material.

87. The invention as in claim 86, wherein said first material is more rigid than said second material.

88. The invention as in claim 86, wherein said second material is more rigid than said first material.

89. The invention as in claim 57, wherein said fastening strips comprise shear action fastening strips.

90. A method of assembling a slider onto a closure device comprising the steps of:

providing a first fastening strip, providing a second fastening strip, providing a slider adapted to be slidably disposed on said fastening strips and facilitating the occlusion of said fastening strips when moved towards a first end thereof and facilitating the deocclusion of said fastening strips when moved towards a second end thereof, said fastening strips and said slider having a longitudinal X axis and a transverse Y axis, said transverse Y axis being perpendicular to said longitudinal X axis, said fastening strips and said slider having a vertical Z axis, said vertical Z axis being perpendicular to said longitudinal X axis, said vertical Z axis being perpendicular to said transverse Y axis, said slider comprising a housing having a top portion, a first side portion, and a second side portion, said first side portion having a first end and a second end, said second side portion having a first end and a second end, said top portion being operably connected to said first end of said first side portion and said first end of said second side portion, said slider having a flexible shoulder facilitating the attachment of said slider onto said fastening strips in said vertical Z axis and preventing removal of said slider from said fastening strips in the vertical Z axis thereafter, said flexible shoulder being operably connected to said second end of said first side portion;

urging said slider over said fastening strips in said vertical Z axis whereby said flexible shoulder deflects to permit passage of said fastening strips into said housing, once said fastening strips have passed into said housing, said flexible shoulder retracting back to its original position thus preventing removal of said slider from said fastening strips in the vertical Z axis thereafter.

91. The invention as in claim 90, wherein said fastening strips comprise U-channel type fastening strips.

92. The invention as in claim 90, wherein said fastening strips comprise arrowhead type fastening strips.

93. The invention as in claim 90, wherein said fastening strips comprise rolling action fastening strips.

94. The invention as in claim 90, wherein said second end of said second side portion is operably connected to a rigid shoulder.

95. The invention as in claim 94, wherein said flexible shoulder is operably connected to a slider leg.

96. The invention as in claim 95, wherein said slider leg projects upwardly and inwardly from said flexible shoulder.

97. The invention as in claim 96, wherein said slider leg and said rigid shoulder define a slot through which said fastening strips pass during attachment of said slider onto said fastening strips in the vertical Z axis.

98. The invention as in claim 90, wherein said flexible shoulder comprises an inner surface and an outer surface.

99. The invention as in claim 98, wherein said inner surface comprises a first radius and said outer surface comprises a second radius.

100. The invention as in claim 95, wherein said slider leg comprises an inner surface, an outer surface, and an end surface.

101. The invention as in claim 100, wherein said inner surface and said outer surface are substantially parallel.

102. The invention as in claim 94, wherein said rigid shoulder projects inwardly from said second side portion.

103. The invention as in claim 101, wherein said rigid shoulder is substantially perpendicular to said second side portion.

104. The invention as in claim 90, wherein said second end of said second side portion is operably connected to a flexible shoulder.

105. The invention as in claim 104, wherein each of said flexible shoulders is operably connected to a slider leg.

106. The invention as in claim 105, wherein said slider legs project upwardly and inwardly from said flexible shoulders.

107. The invention as in claim 106, wherein said legs define a slot through which said fastening strips pass during attachment of said slider onto said fastening strips in the vertical Z axis.

108. The invention as in claim 104, wherein each said flexible shoulder comprises an inner surface and an outer surface.

109. The invention as in claim 108, wherein said inner surface comprises a first radius and said outer surface comprises a second radius.

110. The invention as in claim 105, wherein said each slider leg comprises an inner surface, an outer surface, and an end surface.

111. The invention as in claim 110, wherein said inner surface and said outer surface are substantially parallel.

112. The invention as in claim 110, wherein said inner surface and said outer surface taper toward said end portion.

113. The invention as in claim 110, wherein said end surfaces are substantially parallel and define said slot.

114. The invention as in claim 110, wherein said end surfaces are in substantially the same plane.

115. The invention as in claim 105, wherein each said slider leg comprises a first inner surface, a second inner surface, a first outer surface, a second outer surface, and an end surface, said first inner surface angles upwardly and inwardly from said flexible shoulder, said second inner surface is substantially vertical said first outer surface angles upwardly and inwardly and is substantially parallel to said first inner surface, said second outer surface is substantially vertical and substantially parallel to said second inner surface, said second outer surfaces of slider legs define a slot.

116. The invention as in claim 95, wherein said slider leg operably engages said first fastening strip.

117. The invention as in claim 90, wherein said housing is constructed of a first material and said flexible shoulder is constructed of a second material.

118. The invention as in claim 117, wherein said first material is more rigid than said second material.

119. The invention as in claim 117, wherein said second material is more rigid than said first material.

120. The invention as in claim 90, wherein said fastening strips comprise shear action fastening strips.

121. The invention as in claim 95, wherein said slider leg operably engages said first fastening strip.

122. The invention as in claim 95, wherein said first sidewall is between said slider leg and said first fastening strip.

123. The invention as in claim 95, wherein said first sidewall has a protrusion and said slider leg engages said protrusion.

* * * * *